US006884185B2

(12) United States Patent
Udwin et al.

(10) Patent No.: US 6,884,185 B2
(45) Date of Patent: Apr. 26, 2005

(54) T-BALL PLAYING KIT

(75) Inventors: Steven C Udwin, Tenafly, NJ (US); David Tarica, Tenafly, NJ (US)

(73) Assignee: Enor Corporation, Northvale, NJ (US)

( * ) Notice: Subject to any disclaimer, the term of this patent is extended or adjusted under 35 U.S.C. 154(b) by 39 days.

(21) Appl. No.: 10/212,457

(22) Filed: Aug. 5, 2002

(65) Prior Publication Data

US 2003/0036446 A1 Feb. 20, 2003

Related U.S. Application Data

(60) Provisional application No. 60/310,323, filed on Aug. 6, 2001.

(51) Int. Cl.[7] ..... A63B 69/00; A63B 71/00; B65D 69/00

(52) U.S. Cl. ..... 473/417; 473/422; 206/233; 206/579

(58) Field of Search ..... 473/422, 415, 473/417–420, 386, 387

(56) References Cited

U.S. PATENT DOCUMENTS

| | | | | | |
|---|---|---|---|---|---|
| 2,527,906 | A | * | 10/1950 | Bennett et al. | 473/417 |
| 3,264,677 | A | * | 8/1966 | Olson | 16/2.1 |
| 3,830,362 | A | * | 8/1974 | Tassone et al. | 206/579 |
| 3,863,920 | A | * | 2/1975 | Tassone et al. | 473/417 |
| 3,933,241 | A | * | 1/1976 | Tassone et al. | 206/579 |
| 3,952,477 | A | * | 4/1976 | Candor et al. | 53/452 |
| 4,979,741 | A | | 12/1990 | Butcher | |
| 5,004,234 | A | | 4/1991 | Hollis | |
| 5,388,823 | A | | 2/1995 | Prieto | |
| 5,540,430 | A | * | 7/1996 | Nichols et al. | 473/418 |
| D373,806 | S | | 9/1996 | Bunnell | |
| 5,556,091 | A | | 9/1996 | Lin | |
| 5,893,806 | A | | 4/1999 | Martinez | |
| 5,897,444 | A | | 4/1999 | Hellyer | |
| D410,052 | S | | 5/1999 | Davis et al. | |
| 5,928,092 | A | | 7/1999 | Keeter et al. | |
| D430,243 | S | | 8/2000 | Alberti et al. | |
| D430,629 | S | | 9/2000 | Alberti | |
| D433,722 | S | | 11/2000 | Hsu et al. | |
| D443,662 | S | * | 6/2001 | Udwin et al. | D21/725 |
| D445,331 | S | * | 7/2001 | Udwin et al. | D9/415 |
| 6,296,581 | B1 | * | 10/2001 | Sever | 473/422 |
| D451,566 | S | | 12/2001 | De Chenne | |
| 6,358,163 | B1 | | 3/2002 | Tanner | |
| D467,494 | S | * | 12/2002 | Udwin et al. | D9/415 |

* cited by examiner

*Primary Examiner*—Mitra Aryanpour
(74) *Attorney, Agent, or Firm*—Weingram & Associates, P.C.

(57) ABSTRACT

A baseball playing kit includes telescoping vertical supports mounted on a base plate. An intermediate support is adjustable in height for different sized users. A tapered support holds a foam covered ball at the upper end. The base is divided into segments that can be easily assembled. A lower threaded vertical support is secured to the base by a threaded base member and a locking member secures the base segments together. A foam covered bat is included. The various components are separable for packaging into a small container for shipping and storage and are easily assembled into a complete game unit.

9 Claims, 9 Drawing Sheets

T-BALL PLAYING KIT

RELATED U.S. APPLICATION

This application is based upon and claims the benefit of Provisional Application No. 60/310,323 filed Aug. 6, 2001.

FIELD OF THE INVENTION

The present invention relates to baseball games, and particularly to the game of T-ball.

BACKGROUND OF THE INVENTION

Baseball has been and continues to be a very popular sport in the United States and in many foreign countries. With the development of better medical understanding of the stresses imposed on players, a variation of the baseball game known as T-ball has become increasingly popular as a means of avoiding injury to young players' arms from throwing baseballs at too early an age. The game of T-ball avoids the necessity of having a skilled catcher in order to retrieve balls thrown by a pitcher. T-ball is played by means of placing a ball on some form of mount where it can be hit by a player swinging a baseball bat in the same manner that a player would swing at a ball being thrown by a pitcher. The T-ball holding device is similar in several respects to many batting training apparatuses or batting tees which allow baseball players to practice their swing without the necessity of a human pitcher.

A successful T-ball apparatus requires that the device holding the ball be adjustable to accommodate players of different sizes. The adjustment should be easily accomplished in a short period of time.

Additionally, the pieces of the assembly should be strong enough to withstand the strength of being hit by a baseball bat when the batter swings and misses the ball.

For example, U.S. Pat. No. 4,979,741 entitled "Batting Training apparatus" which issued to Butcher (1990), shows a batting training apparatus with a ball mounted on a vertical stand that enables a user to determine an improper swing.

U.S. Pat. No. 5,004,234 entitled "Adjustable Batting Tee" which issued to Hollis (1991) shows a batting tee in which the vertical ball holding member is movable with respect to the home plate base unit.

U.S. Pat. No. 5,388,823 entitled "Adjustable Baseball Batting Tee" which issued to Prieto (1995) also shows a batting tee in which the vertical ball holding member is movable within a plurality of locations within the strike zone.

U.S. Pat. No. D373,806 entitled "Batting Tee" which issued to Bunnell (1996) shows a batting tee unit in which the vertical ball holding member is movable within the confines of the home plate unit.

U.S. Pat. No. 5,556,091 entitled "Baseball Holder for Baseball Batting Practice" issued to Lin (1996) shows a baseball holder in which the ball holding member can be adjusted radially from and around the center of home plate.

U.S. Pat. No. 5,893,806 entitled "Batting Instruction Method and Apparatus" issued to Martinez (1999) shows a Baseball T that has two ball supporting members.

U.S. Pat. No. 5,897,444 entitled "Ball Support Batting Tee" issued to Hellyer (1999) shows baseball tee that has at least two interconnected arm members that pivot from the base.

U.S. Pat. No. 5,928,092 entitled "Batting Tee for Baseball and Softball" issued to Keeter et al.(1999) shows a baseball tee holder that includes a horizontal member with multiple ball holding means.

U.S. Pat. No. D410,052 entitled "Support Base for a Baseball Batting Practice Tee" issued to Davis et al. (1999) shows a batting Tee whereby the vertical member is slidably connected to home plate.

U.S. Pat. No. 6,358,163 entitled "Durable Batting Tee for Baseball" issued to Tanner (2002) shows an adjustable compression nut and an inverted flexible cone.

Additionally, there are several design patents that also disclose batting Tees: U.S. Pat. No. D430,243 issued to Alberti et al. (2000), U.S. Pat. No. D430,629 issued to Alberti (2000), U.S. Pat. No. D433,722 to Hsu et al., and U.S. Pat No. D451,566 to De Chenne (2001).

Unfortunately, the prior art patents fail to meet the light weight and easily transportable requirements associated with today's young players as well as the dictates of manufacture and shipping required in today's marketplace. Therefore, what is needed is a T-ball device which is easily transportable, light and durable, and can be easily moved from one playing location to another by young players.

Furthermore, what has become ever more important, is that the apparatus should be contained in some form of storage means which allows the components to be broken down into a relatively small space. The small space is extremely desirable since very often these items are made overseas and shipped to the United States. The volume of space occupied by the assembly will have a very large effect on the final price of the goods. The more compact the assembly, the lower the freight charges will be.

SUMMARY OF THE INVENTION

To achieve the aims set forth above, the present invention sets forth an assemblage of parts manufactured of lightweight materials which can be quickly and easily assembled. The height of the holder for the ball can be easily and quickly adjusted.

The entire unit, including the home plate base, can be easily disassembled, thus minimizing its size and bulk for storage and/or for shipping. The home plate base is formed by two interlocking segments which are fixed in position by means of a locking collar. The locking collar also positions the base member that supports a vertical stanchion member that raises the level of the ball holder above home plate.

An extension rod telescopically fits within the upper end of the stanchion member and has a positioning grommet that easily slides along the outer circumference of the extension member to position the extension member so as to elongate and increase the height of the ball holding member located on the end of the extension member.

Storage means are provided with the kit to enable the parts to be disassembled and stored in a compact manner for easy storage and transportation.

OBJECTS OF THE INVENTION

It is therefore an object of the present invention to provide a plastic T-ball game kit.

It is another object of the present invention to provide a T-ball game kit that is easy to assemble and disassemble.

It is another object of the present invention to provide a T-ball game kit that is easy to ship and transport.

It is another object of the present invention to provide a T-ball game kit that is to be used by children and adults of different ages.

It is another object of the present invention to provide a T-ball game kit that is safe and durable.

It is another object of the present invention to provide a T-ball game kit that is adjustable for children and adults.

It is another object of the present invention to provide a T-ball game kit that allows children to practice their baseball swings.

It is another object of the present invention to provide a extra safe T-ball game kit in which the bat and ball are made of foam rubber.

BRIEF DESCRIPTION OF THE DRAWINGS

For a more complete understanding of the present invention, reference may be had to the following description of the preferred embodiments taken in connection with the following drawings, of which.

DETAILED DESCRIPTION OF THE INVENTION

The present invention is principally composed of a home plate unit 10, an apparatus for holding a ball at an elevated position. The invention can also include a bat 12 and a ball 14. The bat consists of a foam rubber material having plastic end caps 16 and 18 and a hollow cylindrical supporting core around which the foam is positioned. Optionally, the bat can include a handle such as that found in U.S. Pat No. D443, 907 to Tarica.

Figure 1:
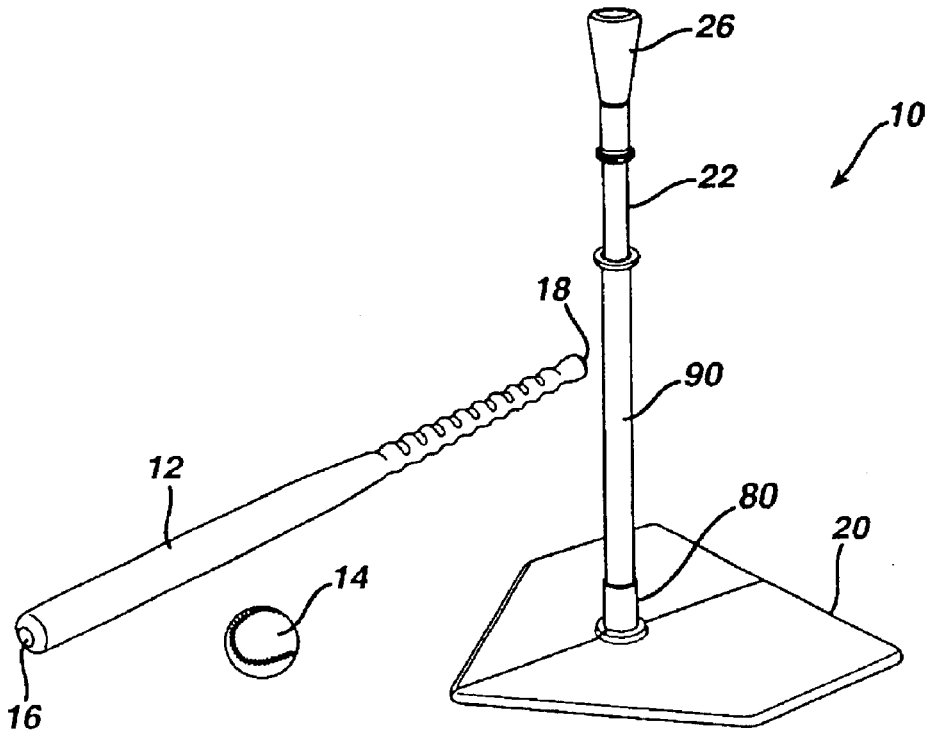
FIG. 1 is a perspective view of the various components of the T-ball game kit of the present invention.
Figure 2:
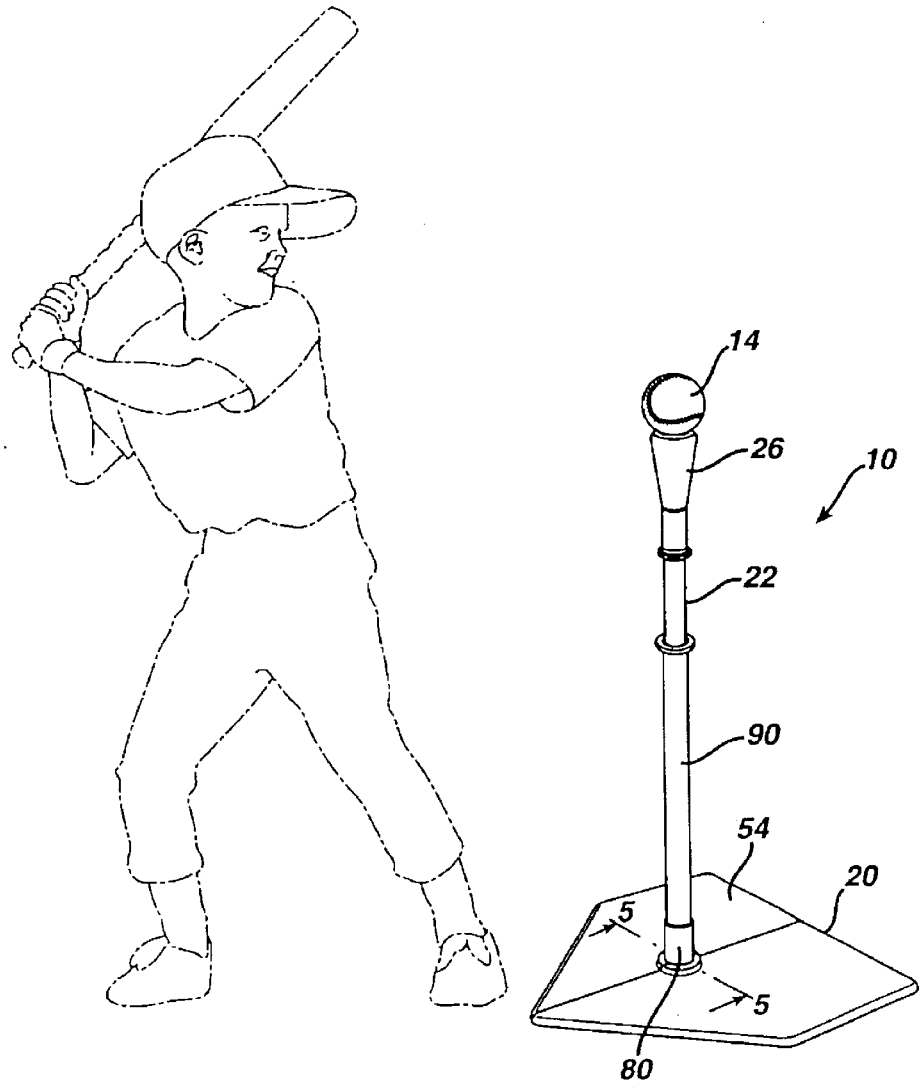
FIG. 2 is a view of the home plate unit, adjusted to an intermediate height position.
Figure 3:
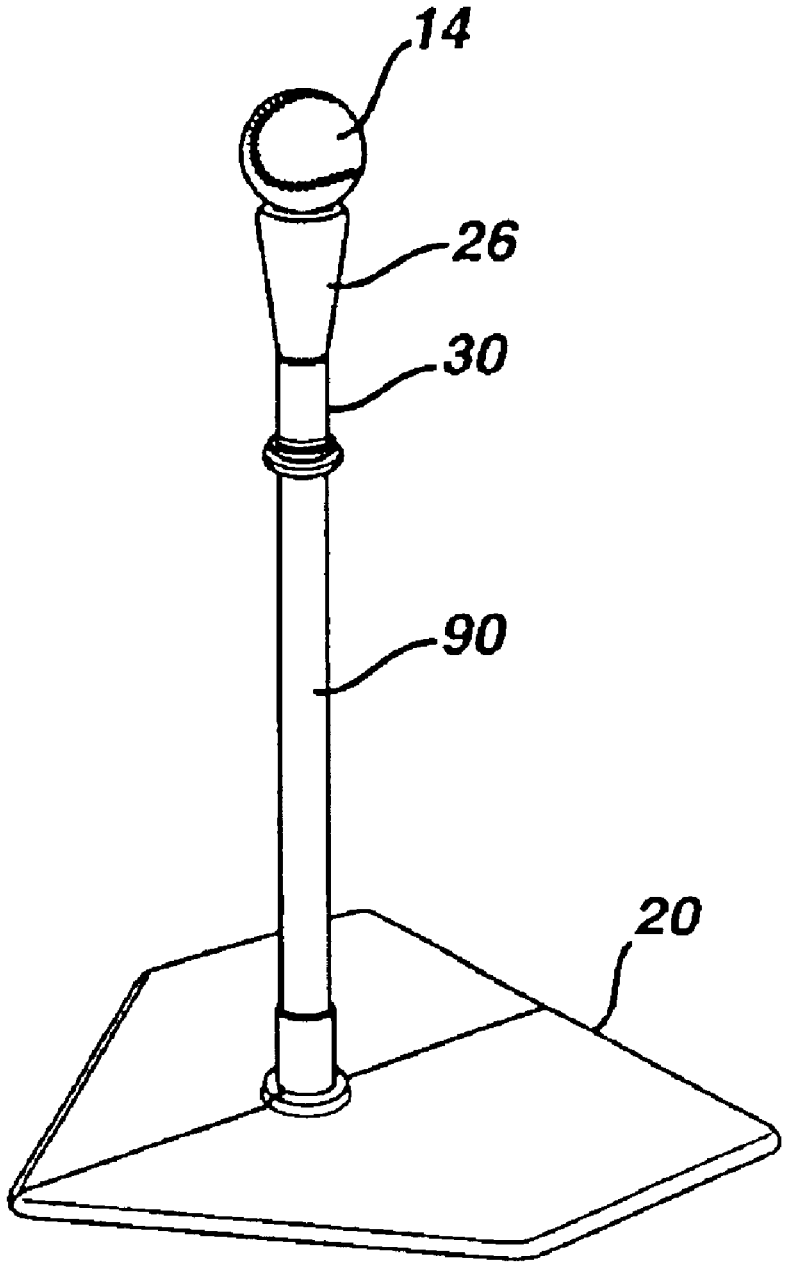
FIG. 3 is a view of the assembled home plate unit with the extension member retracted to its minimum length and the ball resting on top of the ball holding unit.

FIG. 2 shows a T-ball player in a position ready to swing the bat at the ball resting on top of the home plate unit. The home plate unit includes a home plate 20, a stanchion supporting base 80, a stanchion member 90, an extension member 22 and a T-Ball holding member 26. The home plate, the stanchion supporting base, the stanchion member, the extension member and the T-ball holding member can be made of plastic or any other suitable material, such as wood or aluminum. When assembled, the extension member may be retracted as shown in FIG. 3, extended as shown in FIG. 1, or in an intermediate position as shown in FIG. 2.

Figure 4:
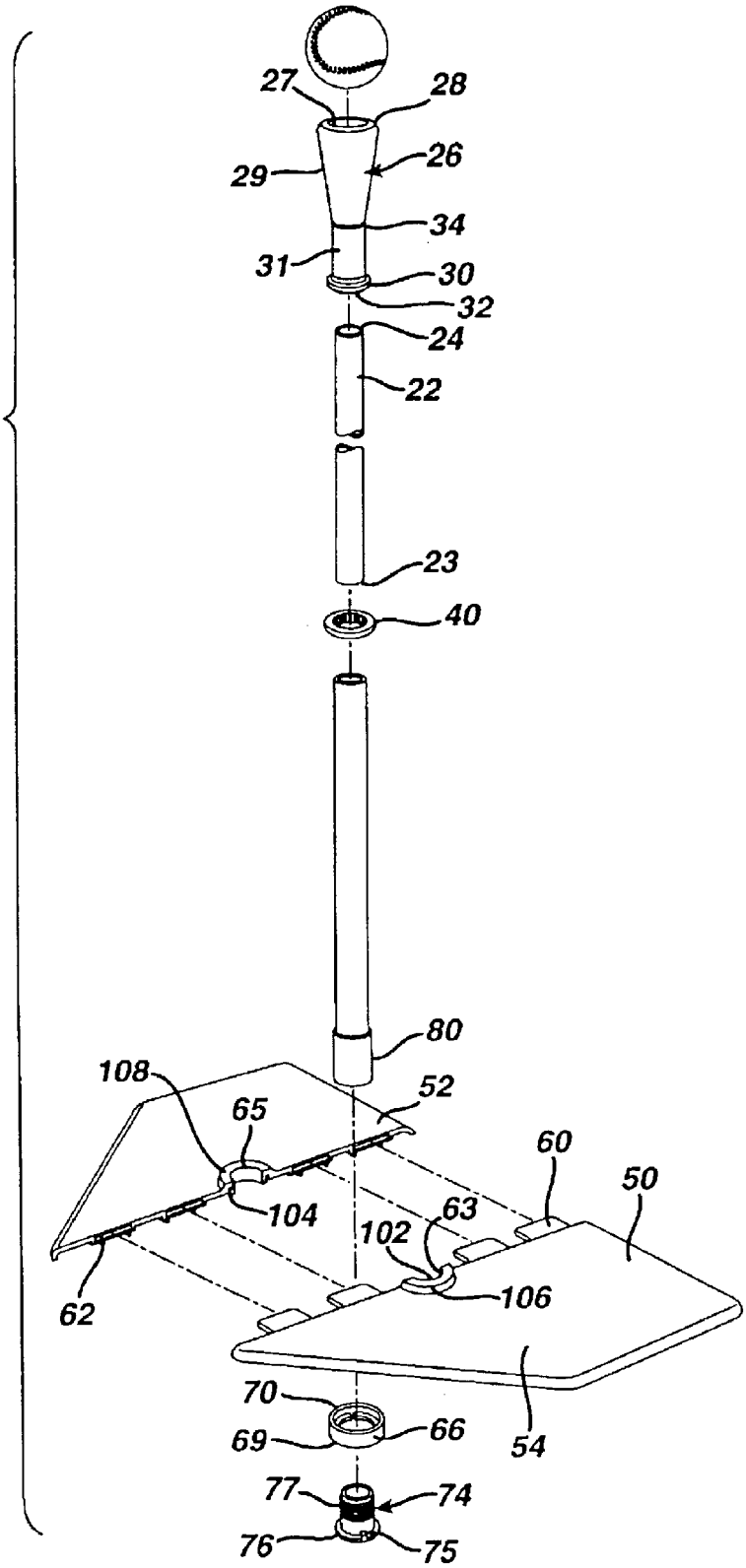
FIG. 4 is an exploded view of the Home plate unit showing the various components of the assembly.
Figure 5:
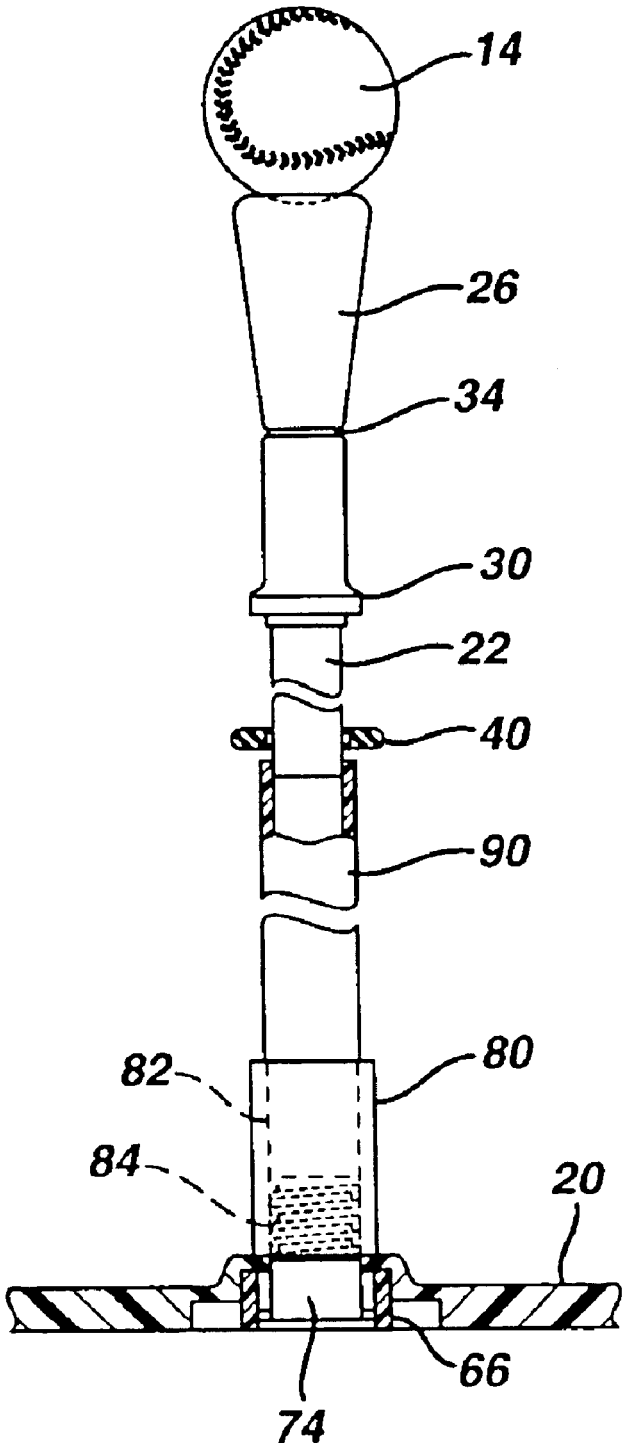
FIG. 5 is a side view showing the assembled home plate unit with certain components in partial cross section.
Figure 6:
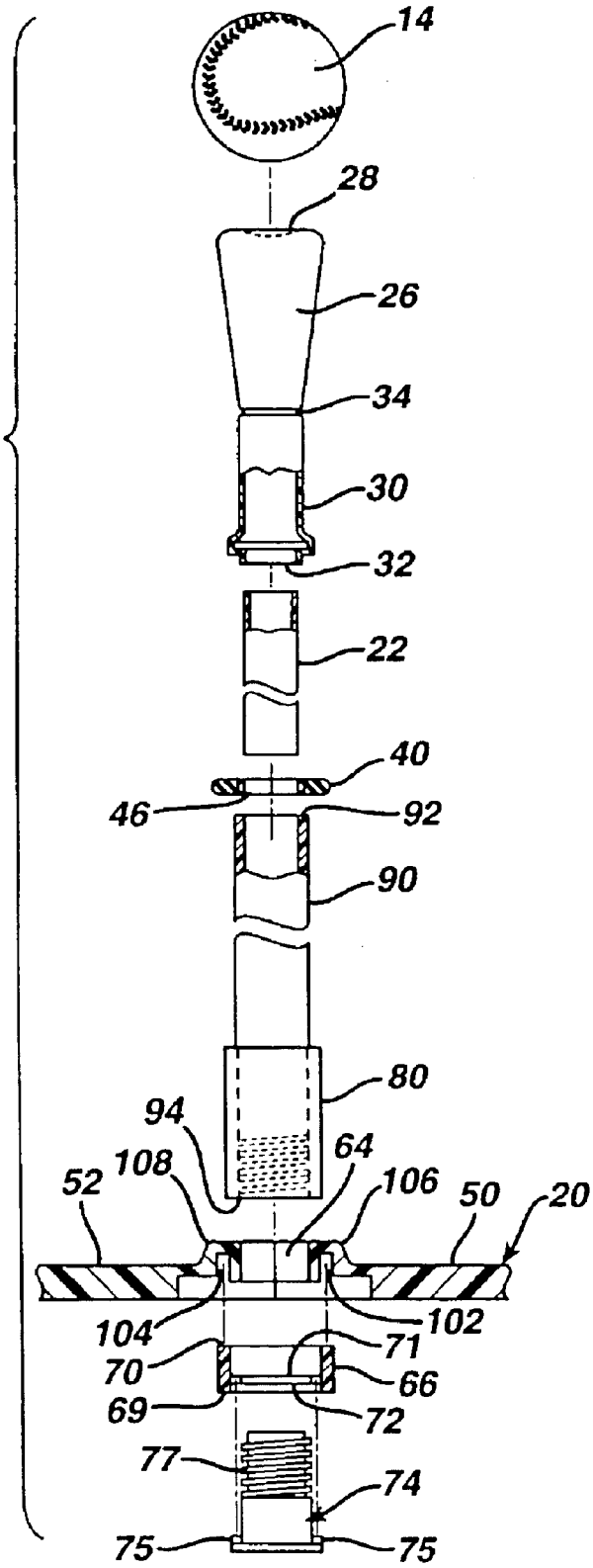
FIG. 6 is an exploded view of the T-ball holding member showing certain components in partial cross section.

The T-ball holding member 26, as further illustrated in FIGS. 4, 5 and 6, has a top 28 and bottom 30. The top 28 includes an inwardly curved shaped cup 27 upon which the ball 14 is placed. The bottom 30 of this holding member includes an opening 32 into which one end of the extension member 22 is inserted. The T-ball holder contains a horizontal annular depression 34 designating the juncture of the lower cylindrical portion 31 from the upper tapered portion 29 of the T-ball holding member. The inner surface of the annular depression 34 provides an internal stop for the end of the extension member 22 when it is inserted into the bottom 30 of the T-ball holding member.

The extension member 22, shown in FIGS. 1, 2, 4, 5 and 6, is tubular and hollow and has both a bottom end 23 and a top end 24.

Figure 8A:
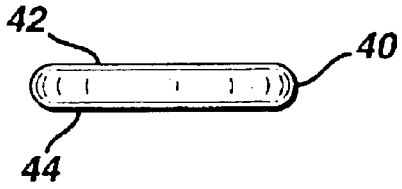
FIG. 8*a* is a side view of the positioning grommet.
Figure 8B:
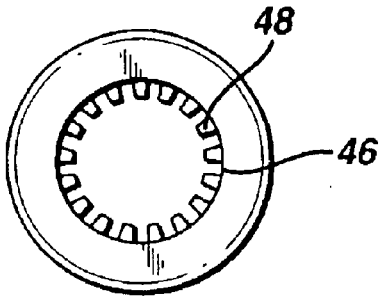
FIG. 8*b* is a top view of the positioning grommet.
Figure 9A:
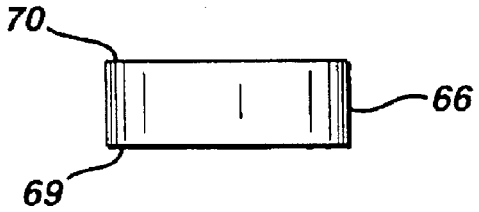
FIG. 9*a* is a side view of the locking nut which joins the locking collar to hold the two segments of home plate together.
Figure 9B:
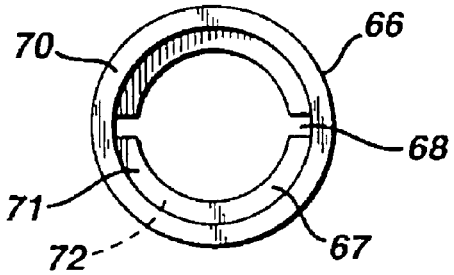
FIG. 9*b* is a top view of the locking nut showing the grooves in the flange, which receives the base screw member.

FIGS. 4, 5, and 6, show a positioning grommet 40 which is placed around the extension member 22 for purposes of vertically adjusting the height of the extension member. The grommet is preferably made of plastic or rubber. As shown in FIGS. 8*a* and 8*b*, the positioning grommet 40 has an upper face 42, a lower face 44 and a bore 46. Resilient positioning fingers 48 extend into the bore of the positioning grommet. As can be seen from FIGS. 5 and 6, the diameter of the bore 46 is smaller than the outer diameter of the stanchion member 90 so that the positioning grommet will sit on the top of the stanchion member and cannot be positioned lower than the top of the stanchion member. The diameter of bore 46 is wider than the outer diameter of the extension member 22, but the ends of the resilient positioning fingers 48 form a circular opening which has a circumference which is smaller than the outer circumference of the extension member.

Therefore, the positioning grommet can be slid over the extension member by deformation of the resilient positioning fingers 48 and slid along the extension member 22 until a desired extension length is achieved. The extension member will then telescope into the upper end of stanchion member 90 up to the position of the positioning grommet. The deformation of the resilient positioning fingers is sufficient to hold the positioning grommet in its location against the combined weight of the extension member and the T-ball holding member.

FIGS. 3–6 show a stanchion member 90. The stanchion member is a tubular cylinder with an upper end 92 and a lower end 94. The inner diameter of the stanchion member is such that the extension member can be slidably inserted inside.

FIGS. 3–6 also show a stanchion supporting base 80. The stanchion supporting base has an upper, non-threaded end 82 and a lower threaded end 84. The upper end of the stanchion supporting base has a diameter sufficient to receive the lower end of the stanchion member. The lower end of the stanchion supporting base is threaded to receive the threaded base screw member 74.

Figure 7:
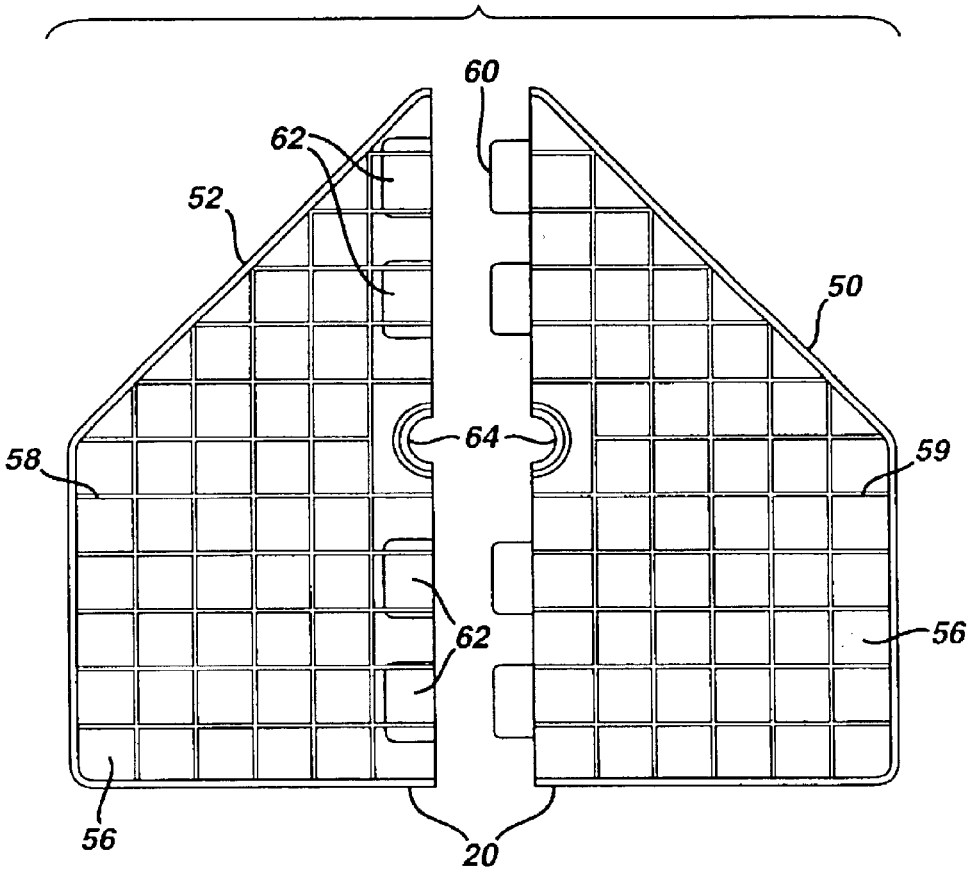
FIG. 7 is a bottom view of the home plate showing the male and female portions before assembly.

FIGS. 2, 4 and 7 show top and bottom views of a home plate 20. The home plate is pentagon-shaped and is comprised of two segments, a male segment 50 and a female segment 52. The male segment and the female segment each have a top side 54 and a bottom side 56. The bottom sides of both the female 52 and male 50 segments contain structural strengthening ribs 58 and 59, respectively. The male and female segments 50 and 52, respectively have raised portions 106 and 108. The raised portions include arcuate semi-circular grooves 102, 104, respectively, circumferentially disposed about the aperture 64 which is formed by semi-circular grooves 102 in male segment 50 and 104 in female segment 52. The male segment has joining fingers 60, while the female segment has corresponding joining pockets 62. Each of the male and female segments contain a semi-circular groove 102, 104, respectively of a locking collar 66.

FIGS. 4, 5, 6, 9*a* and 9*b* show a locking collar 66. The locking collar 66 has a bottom 69 and top 70. Additionally, located on the interior surface of the locking collar is a flange 67 that contains grooves 68. The flange contains an upper face 71 and a lower face 72. The locking collar 66 is positioned within the ring formed about aperture 64, which ring is formed by the semi-circular grooves 102 and 104 in home plate segment member 50 and 52 when the segments are assembled to form home plate.

FIGS. 4 and 6 show the threaded base screw member 74. The threaded base screw member has a screw head 76 that contains extensions 75 at opposite sides. The extensions 75 engage grooves 68 in locking collar 66 when the home plate 20 is assembled. The threaded base screw member fits through the bottom of the locking collar and aperture 64 of the assembled plate to engage the threaded end of the stanchion supporting base.

Figure 10:
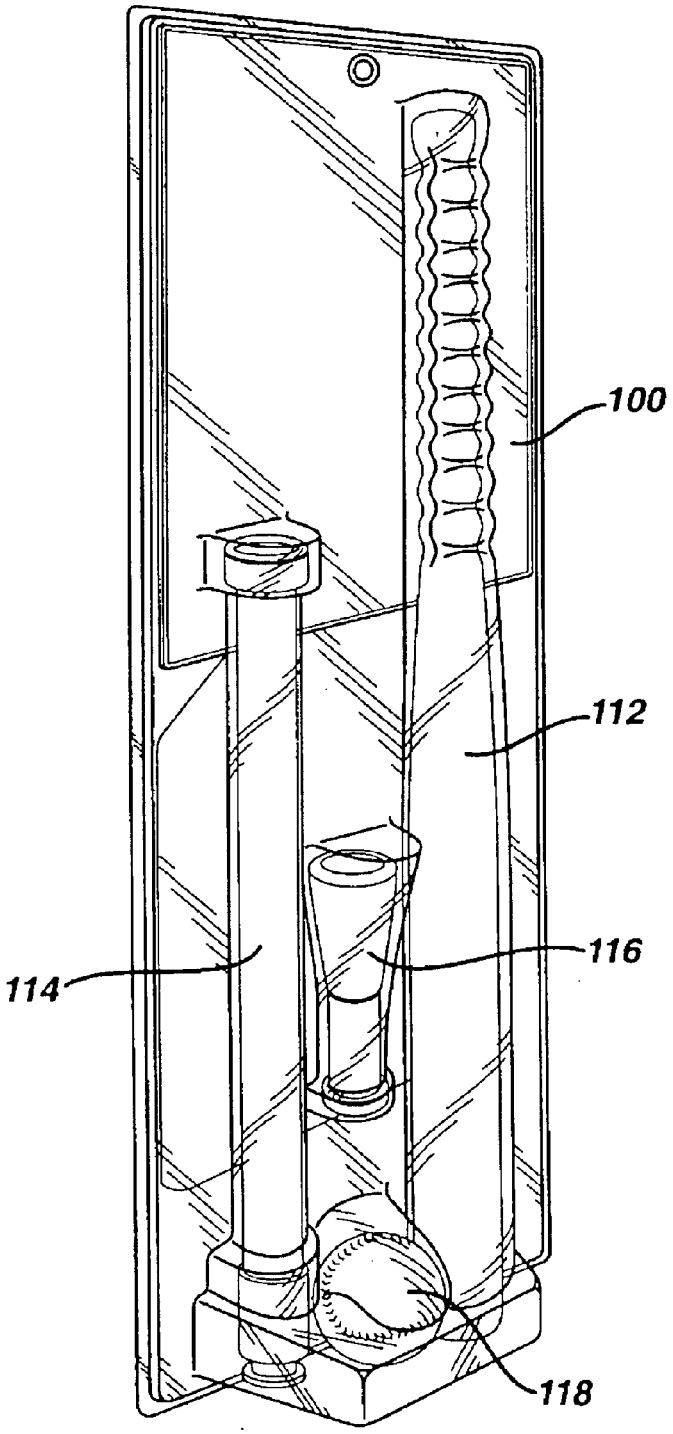
FIG. 10 is a perspective view of the component parts of the present invention contained in plastic packaging forming a kit.

FIG. 10 shows a packaging container made of clear molded plastic which contains a top half and a bottom half designed to compactly hold all of the components of the game kit.

To use the kit described, only the home plate 10 needs assembly. Before assembly begins, the component pieces must be removed from the plastic packaging container 100.

The home plate unit is assembled from the bottom up, i.e., from the home plate up to the T-ball holding member. Home plate is assembled by putting the joining fingers 60 of the male segment 50 into the joining pockets 62 of the female segment 52, as shown in FIG. 4. The locking collar 66 is then placed in the circumferential groove about aperture 64 formed by arcuate grooves 102, 104 so that the locking collar holds the male and female segments of home plate together. The threaded base screw member 74 is inserted through the locking collar 66 as shown in FIGS. 4 and 6, in such a manner that the extensions 75 fit into the grooves 68 of the locking nut and the locking collar is held firm by friction fit in the circumferential groove 110. When properly inserted, the threaded base screw member will not rotate separately from the locking collar. Additionally, the threaded portion 77 of the base screw member 74 will extend past the top of the raised portion of home plate as shown in FIG. 5.

The lower threaded end 72 of the stanchion supporting base 80 is then screwed onto the protruding threaded portion of the threaded base screw member 74. The stanchion member, if not already so, is inserted in the stanchion supporting base. The positioning grommet 40 is then placed on extension member 22 which then is inserted into the stanchion member 90. The positioning grommet on the extension member will abut the top of the stanchion member. Next, the T-ball holding member 26 is inserted on top of the extension member, as shown in FIGS. 4–6. This is accomplished by placing the top of the extension member 22 into the bottom opening 32 of the T-ball holding member. The home plate unit is now completely assembled. To disassemble the home plate unit, the aforementioned process is preferably performed in reverse order, going from top to bottom, i.e., from T-ball holding member to home plate.

In storing or packing the components of the present invention, the following is the preferred order of steps. First, the bat, the ball, and the T-ball holding member are placed into the bottom half of the packing container 100 having depressions formed to hold these items, 112 for the bat, 114 for the stanchion, 116 for the extension members, and 118 for the ball holding member. Before placing the stanchion member in the packaging container, the positioning grommet should be placed on the end of the extension member, which should then be placed inside the stanchion member. The locking nut should then be placed on the other end of the stanchion member and the threaded base screw should be inserted into the threaded end of the stanchion supporting base, and the whole assembly placed into the bottom half of the packaging container. The top half of the packaging container is now placed on top of the bottom half of the packaging container. The female segment of home plate is slid into the proper molded portion of the top half of the packaging container and the male segment of home plate is slid under the female segment of home plate and into the proper molded portion of the top half of the packaging container. FIG. 10 shows a top view of the present invention inside the packaging container.

The present invention is used for children as well as adults who want to either play a game of T-ball with others, or who may want to practice their batting. After assembling the home plate unit, the T-ball batter approaches the home plate unit and adjusts the height of the T-ball holding member. The adjustment is accomplished by moving the extension member either up or down, with the positioning grommet resting on top of the stanchion member. The desired height of the T-ball holding member may depend on such factors as the batter's height, age, and swing. Once the T-ball holding member is adjusted, the ball is then placed on the T-ball holding member. The batter then approaches the home plate unit with bat in hand, as illustrated in FIG. 2, just as a baseball player would approach home plate in a normal baseball game. After positioning himself or herself in front of the home plate unit, the batter swings at the ball located on top of the T-ball holding member, hoping to hit the ball. If the swing is successful or the ball falls off the T-holder, the ball is retrieved, repositioned and the batter tries again. If the swing is unsuccessful, the batter may still swing again.

LIST OF ELEMENTS

10 home plate unit
12 bat
14 ball
  16, 18 end caps
20 home plate
22 extension member
  23 bottom end
  24 top end
26 T-ball holding member
  27 inwardly curved shaped cup
  28 top
  29 upper tapered portion
  30 bottom
  31 lower cylindrical portion
  32 opening
  34 annular depression
40 positioning grommet
  42 upper face
  44 lower face
  46 bore
  48 resilient positioning fingers
  50 male segment
  52 female segment of 20

54 top side—50,52
56 bottom side—50,52
58 structural strengthening ribs—58
59 structural strengthening ribs—50
60 joining fingers
62 joining pockets
64 aperture
65 semi-circular depression—50
66 locking collar
67 flange
68 grooves
70 top
71 lower face
72 upper face
74 threaded base screw member
75 extensions
76 head
77 threaded end
80 stanchion supporting base
82 lower, threaded end
84 upper, non-threaded end
90 stanchion member
92 upper end
94 lower end
100 packaging container
102 groove 50
104 groove 52
106 raised position 50
108 raised position 52
112 depression for holding bat
114 depression for holding extension and stanchion
116 depression for holding ball holder
118 depression for holding ball
120 molded holder for 52
122 molded holder for 50

It will be understood that the embodiments described herein are merely exemplary and that a person skilled in the art may make many variations and modifications without departing from the spirit and scope of the invention. All such modifications and variations are intended to be included within the scope of the invention as described herein.

What is claimed is:

1. A baseball game playing apparatus comprising:

a base member comprising two halves, a ball support member mounted on said base member, said ball support member including a first vertical support member extending upwardly from said base member, a means for securing the first vertical support member to the base member, including means for securing together the two halves of the base member, second vertical support member engageable with and extendable from said first support member, means for adjusting and setting the vertical height of said second support member with respect to said first support member, a ball holding member engageable with and extending vertically from said second vertical support member, said ball holding member including means at the upper end for receiving and holding a ball, said base member including a central opening, said first vertical support member including a lower threaded end supporting member extending into said opening, and a threaded base member extending from the bottom of said base member into said opening and engaging said threaded end support member of said first vertical support member, wherein said base member is divided along a center line into two separable horizontally extending mating segments, a first segment having spaced protrusions along said centerline, and a second segment having spaced pockets along said centerline, said protrusions being engageable with said pockets, said central opening providing a locking collar divided by said centerline into two halves within respective segments.

2. The apparatus of claim 1 including a locking nut insertable into said central opening said nut securing said halves of said locking collar and segments together.

3. The apparatus of claim 2 wherein said threaded base member is insertable through said central opening and locking nut into said threaded end support member of said first vertical support member for securing said first vertical support member to said base member.

4. The apparatus of claim 3 wherein said means for adjusting and setting the vertical height of said second vertical support member extendable from said first support member includes a grommet positioned around and engaging said second support member at a selectable position along the length of said second support member.

5. The apparatus of claim 4 wherein the first vertical support member is a hollow tubular member having said end support member internally threaded at the lower end, the upper end of said first support member receiving the lower end of said second vertical support member to an adjustable height set by said grommet selectable position.

6. The apparatus of claim 5 wherein said second vertical support member is a hollow tubular member, said ball holding member including a lower hollow tubular end receiving the upper end of said second vertical support member, the upper section of said ball holding member tapering outwardly and having an inwardly curved end for receiving and holding a ball.

7. The apparatus of claim 5 wherein said grommet includes flexible fingers extending inwardly and engageable with said second support member at a selectable position.

8. The apparatus of claim 7 wherein said grommet has an inner diameter bore smaller than the outer diameter of said first vertical support member.

9. The apparatus of claim 1 wherein said base member includes strengthening ribs on the underside of each said base segment.

* * * * *